US012220042B2

(12) United States Patent
Fogueteiro

(10) Patent No.: US 12,220,042 B2
(45) Date of Patent: Feb. 11, 2025

(54) COSMETIC PRODUCT APPLICATOR INCLUDING SPIRALLING BRANCHES AND SET INCLUDING SUCH AN APPLICATOR

(71) Applicant: CHANEL PARFUMS BEAUTE, Neuilly-sur-Seine (FR)

(72) Inventor: Paulo Fogueteiro, Neuilly sur Seine (FR)

(73) Assignee: CHANEL PARFUMS BEAUTE, Neuilly-sur-Seine (FR)

( * ) Notice: Subject to any disclaimer, the term of this patent is extended or adjusted under 35 U.S.C. 154(b) by 0 days.

(21) Appl. No.: 18/379,981

(22) Filed: Oct. 13, 2023

(65) Prior Publication Data

US 2024/0122332 A1 Apr. 18, 2024

(30) Foreign Application Priority Data

Oct. 14, 2022 (FR) ..... 2210597

(51) Int. Cl.
*B43M 11/02* (2006.01)
*A45D 40/26* (2006.01)

(52) U.S. Cl.
CPC ..... *A45D 40/265* (2013.01); *A45D 40/261* (2013.01); *A45D 40/262* (2013.01); *A45D 2200/10* (2013.01); *A46B 2200/1046* (2013.01); *A46B 2200/1053* (2013.01)

(58) Field of Classification Search
CPC .. A45D 40/261; A45D 40/262; A45D 40/265; A46B 2200/1046; A46B 2200/1053
USPC ..... 401/126, 129, 218
See application file for complete search history.

(56) References Cited

U.S. PATENT DOCUMENTS

| | | | | |
|---|---|---|---|---|
| 11,412,832 | B2 * | 8/2022 | Bose | A45D 34/046 |
| 11,457,718 | B2 * | 10/2022 | Garrison | A45D 34/046 |
| 12,011,078 | B2 * | 6/2024 | Kingswell | A45D 34/04 |
| 2012/0201593 | A1 | 8/2012 | Priore | |
| 2017/0020266 | A1 | 1/2017 | Sanchez | |
| 2024/0180320 | A1 * | 6/2024 | Von Jan | A46B 9/025 |

FOREIGN PATENT DOCUMENTS

| | | |
|---|---|---|
| EP | 3 528 660 B1 | 8/2020 |
| EP | 3 942 966 | 1/2022 |
| EP | 4 066 682 | 10/2022 |
| FR | 3 013 197 A1 | 5/2015 |
| FR | 3 014-656 | 6/2015 |
| KR | 20-2013-0005299 | 9/2013 |
| KR | 10-1855918 | 5/2018 |

OTHER PUBLICATIONS

Preliminary Search Report issued in French Patent Application No. FR2210597, dated May 30, 2023.

* cited by examiner

*Primary Examiner* — Jennifer C Chiang
(74) *Attorney, Agent, or Firm* — GREENBLUM & BERNSTEIN, P.L.C.

(57) ABSTRACT

A cosmetic-product applicator including an application endpiece and a gripping element adapted to be grasped by a user, the application endpiece including branches which extend while spiraling around a main axis so that they define a cavity having an axisymmetric general shape around the main axis. The application endpiece is mounted free in rotation about the main axis in relation to the gripping element.

16 Claims, 3 Drawing Sheets

COSMETIC PRODUCT APPLICATOR INCLUDING SPIRALLING BRANCHES AND SET INCLUDING SUCH AN APPLICATOR

CROSS-REFERENCE TO RELATED APPLICATION

The present application claims priority under 35 U.S.C. 119 of French Patent Application No. FR 2210597, filed Oct. 14, 2022, the disclosure of which is expressly incorporated by reference herein in its entirety.

The present invention relates to the field of cosmetic product applicators.

In particular, it relates to an application endpiece adapted for the application of a liquid, viscous or pasty cosmetic product on the skin, for example over the contour of the eyes, in particular under the eyes. In general, in the present document, the application of a cosmetic product on the skin is considered, yet without limiting the invention to this application area.

In the present document, an application endpiece refers to the portion of an applicator intended to be brought into contact with the skin to apply the cosmetic product.

In the present document, the cosmetic products include in particular all products for making up the skin, the lips or the dander. The applicator object of the present invention is also suitable for application of care products, in particular liquid and pasty care formulas, intended for application on the skin, the lips or the dander. For simplicity, throughout the present document, when reference is made to a cosmetic product, this also includes care products.

Of course, in the remainder of the present document, the term "user" indifferently refers to a male user or a female user.

The cosmetic products should be homogeneously deposited over the skin, in an even, fine layer. Ideally, the applicator should also enable a light massage of the application area of the cosmetic product. A freshness feel upon application may also be desired.

Various applicators have been considered for this purpose.

Thus, the most frequent applicators that are suited for application of cosmetic products are the "pressed tube" type applicators, the "stick with applicator endpiece" type applicators, and the applicators with a rotary ball often referred to as "roll-on".

The "pressed tube" type applicators include a flexible tube containing the product to be applied. The tube should be pressed to cause the discharge of the product, via an orifice located on a relatively planar and generally metallic application area, in order to confer a freshness feeling upon application. The amount of product delivered with this applicator type is inaccurate because it depends on the force applied on the tube. Furthermore, spreading the product using the application surface is done by friction on the skin, which does not allow depositing an even product film. Friction during application may also be aggressive and even irritating to the skin.

The "stick with an applicator endpiece" type applicators include a stick made of metal with a rounded endpiece. The stick and its endpiece should be immersed in the cosmetic product for the endpiece to be covered with the product. The application of the product is done by rubbing the endpiece on the skin of the user, or by depositing product spots by repeated contacts of the applicator on the skin. Like with a pressed tube type applicator, this does not enable an even application of the product. Friction during application may also be aggressive and even irritating to the skin. Furthermore, some product tends to lodge between the stick and the endpiece and forms a mass that is not applied.

Finally, the "roll-on" applicators generally include a flexible tube and an endpiece with a rotatably-mounted ball which is loaded with product over its surface internal to the endpiece when the tube is pressed. Afterwards, the surface of the ball loaded with the product is rotated towards the outside of the endpiece, while rolling over the skin of the user, to enable the application of the product. This applicator type does not enable an accurate dosage of the applied product, the tube having to be pressed to load the ball. The quality of the application depends on the orientation of the applicator, the endpiece having to be oriented downwards to enable a proper application.

In fine, applicators whose surface is smooth, whether they are used by rubbing or by rolling on the skin do not enable an accurate dosage of the applied amount of product.

The document FR3013197 discloses an applicator whose endpiece has an axisymmetric shape and striations. During the application of the product, the applicator could be moved in contact with the skin by making it slip on the latter, possibly with a rotational movement of the application member on itself about an axis parallel to the longitudinal axis of the stick and/or perpendicular to this longitudinal axis. Hence, it is upon the user to ensure an adequate application movement, according to a gesture that is not easy to carry out, which does not allow guaranteeing an even application of the product.

The document EP3528660 discloses an applicator for a cosmetic product which includes a gripping member extending along a longitudinal axis, a stick carrier arranged in the gripping member, a stick secured to the stick carrier and a cosmetic product application member mounted movable in rotation about the longitudinal axis relative to the gripping member. Nevertheless, this applicator has some drawbacks. In particular, the application endpiece is not optimised for the retention of the cosmetic product and an even release of the cosmetic product during application.

The present invention aims to provide an endpiece for applying a cosmetic product, including liquid, viscous or pasty care products, enabling an even and continuous application of an accurate dose of product over an application area having a defined surface, which could be relatively large, while enabling a massage of the entire application area. Preferably, such an application should be possible in a simple and ergonomic manner, with a gesture that is obvious to the user.

To this end, the invention relates to a cosmetic product applicator including an application endpiece and a gripping element adapted to be grasped by a user, the application endpiece including branches which extend while spiralling around a main axis so that they define a cavity having an axisymmetric general shape around the main axis, the application endpiece being mounted free in rotation about the main axis relative to the gripping element.

The presence of branches that spiral around a cavity which has an axisymmetric shape, allows for several effects and advantages. The cavity forms a space for the retention of the cosmetic product. Its volume could be adapted according to the accurate amount of product that the applicator should retain, corresponding for example to the desired dose for application of the product in a given area, for example under the eyes. Many other application areas may be considered, in particular all areas of the face or of the neck.

More generally, the configuration of the applicator may be adapted to the nature and to the properties of the product that the application endpiece is intended to apply. As regards the nature, or the type, of the product, a serum should for example be applied in a smaller amount than a cream. The application endpiece may be configured to retain the right dose, depending on the considered product. As regards the properties of the product, for example an application endpiece having branches spaced apart from each other is more suited for a viscous product (in terms of retention and progressive delivery of the product), whereas an application endpiece having tighter branches is more suited for a fluid product.

The fact that the branches form spirals allows accompanying, naturally guiding, the movement of the user during the application of a cosmetic product. The free rotatable mounting of the application endpiece enables it to roll on the skin during the application, simply by the effect of the gesture of the user. No means, for example electrical, causes the rotation of the applicator endpiece. Furthermore, the spiralling shape of the branches causes a progressive adhesion on the skin, without jerking, as the application is caried out.

More specifically, the spiralling configuration of each branch makes the branch bear on the skin as any rotational movement is imparted to the application endpiece during the application of the cosmetic product. The branches enable a given adhesion of the application endpiece on the skin, and their configuration enables that this adhesion is even, regardless of the angular position of the applicator upon contact with the skin. No jerking is caused by the branches during the rotation of the application endpiece about its main axis, whereas it is in contact with the skin. Thus, the rotation enables a progressive adhesion of each of the branches on the skin. The spiraling configuration ensures that each branch "unwound" over the skin as the application endpiece is rotated.

Nevertheless, thanks to the spiraling branches, rolling of the applicator endpiece on the skin may result in alternate presses on the skin (like "wavelets") promoting a blood microcirculation in the application area. Thus, the branches contribute to the massaging effect, rolling of the applicator fitted with spiraling, for example helical, branches causing a slight overpressure whose position evolves longitudinally (relative to the applicator) when the application endpiece rolls on the skin.

Thus, the effect is similar to that of a tapotement gesture which is recommended for the application of a cosmetic product on the eye area. In particular, it is possible to configure the branches so that substantially the same branch area is in contact with the skin throughout an application of a cosmetic product.

The rotary nature of the application endpiece improves the evenness of the application, avoids the formation of a product mass, and enables an even and soft application without requiring a complex movement from the user. Thus, the gesture to be performed to apply the product is simple and straightforward.

The concepts of "spiral" and "to spiral" refer to the fact that the branches turn around the main axis of the applicator, which defines the longitudinal direction, while progressing longitudinally. Hence, the spiral formed by the branches may, in particular, be a helix, or a series of helix portions, whose pitch and/or radius are set of variable. In practice, a branch forms a turn or a turn portion.

The cavity may be devoid of any inner element. On the contrary, the cavity may include a central element, extending over the main axis. A cavity with no inner element allows maximising the volume for retaining the cosmetic product, and could, in some embodiments, increase the flexibility of the branches. A longitudinal central element passing through the cavity allows modulating its volume (and therefore modulating the amount of product retained in the applicator), and could increase the rigidity of the application endpiece.

The branches of the application endpiece may be configured so as to be more or less flexible or rigid and, consequently, more or less transversely deformable. This flexibility is reflected by the flexural modulus of each branch.

The flexibility of the branches may be adapted in particular by selecting the material constituting them, and/or by selecting the cross-section of the branches. For example, the flexibility of a branch may depend on its diameter for a circular cross-section branch. More generally, it depends on the shape and the surface of the cross-section of the branch (which may be constant or vary along the branch). This reflects what could be referred to in general as "the thickness" of the branch.

Adapting the flexibility or rigidity of the branches allows obtaining a trade-off between the massaging effect of the applicator and its ability to deliver the product it contains. Thus, a rigid branch enables a firmer, less dampened, press on the skin, than a flexible branch. An application endpiece with flexible branches results in a greater delivery of the product it contains when it is applied on the skin and rolled, than an applicator with rigid branches.

Based on these principles, the same application endpiece may be provided with branches with different rigidities, for example by alternating softer branches, which will deform upon application, and more rigid branches, which will deform less. This allows cumulating a great massaging effect with an adequate distribution of the product upon application.

Similarly, the same branch may be more flexible over a portion of its length and more rigid over another portion.

The flexibility of the branches of the application endpiece may also enable a better fitting of the applicator to the application areas to which it is intended. For example, for a face application, this enables the applicator to adapt to the curves present in the preferred application area, and possibly in general to the curvatures of the entire face.

The cavity may have a so-called bud-like shape, i.e. an elongate axisymmetric shape flaring progressively and terminating in a rounded tip. Alternatively, the cavity may have a spherical, axisymmetrically cylindrical, pear-like, ogive-like general shape, or any other suitable axisymmetric shape.

A bud-like shape is particularly well-suited as it enables an effective application of the cosmetic product while holding the applicator according to various orientations with respect to the application surface in particular thanks to a large rounded tip.

The branches may be devoid of protuberances.

By protuberance, it should be understood any prominent projection at the surface of the branch. In particular, the branch is devoid of teeth or hairs. However, this does not exclude the presence of local patterns or deformations at the surface of the branches, or the presence of a coating, which creates a texture at the surface of the branches. As examples, a flocking (for example to obtain a "velvet" finish), or a microparticle-based coating, is particularly possible.

The application endpiece of the application may include exactly three, four, five, six, seven, eight, nine or ten branches.

A large number of branches promotes the retention of the cosmetic product in the cavity, but makes access to the product cavity difficult. A large number of branches also promotes a regular roll of the application endpiece at the surface of the skin. A small number of branches promotes a blood micro-circulation in the application area by a "tapotement" effect over the application area. A small number of branches, in particular because the number of branches conditions the space between two adjacent branches of the application endpiece, is also associated with a lesser retention and with a quicker and greater distribution of the product.

Each branch may turn while spiraling around the main axis by an angle comprised between 90° and 720°, preferably in the range of 180°. Thus, each branch forms between one quarter-turn and two turns around the main axis of the applicator. A suitable number of turns may be selected in particular according to the length (longitudinal dimension) of the application endpiece. The rotation angle that each branch forms around the main axis confers on the branches an angle with respect to the direction of rolling of the application endpiece over the skin that is not too large in order to enable a good adhesion on the skin, while being adapted to properly accompany the movement of the applicator.

Throughout the present document, "about" or "in the range of" corresponds to the indicated value more or less 20%.

The branches of the application endpiece, and where appropriate the other elements of the application endpiece, may be metallic, made of ceramic, of wood, of glass, or of a plastic material.

An application endpiece whose branches are metallic offers a freshness feel to the user upon application. A skin decongestant effect may also be obtained. This also confers on the application endpiece an aesthetically-pleasing appearance. A metallic or ceramic endpiece is generally perceived as a high-quality object by the user. An endpiece made of wood, or another natural material, may be obtained in an environmentally-friendly manner and does not pose any recyclability problem. The use of plastic facilitates the manufacture and limits the cost of the application endpiece.

Each branch may include at the surface a protruding or recessed texture, which increases its roughness. This texture may be obtained by forming a pattern over the surface of the branches, which allows for a better hooking on the skin, and a better retention of the cosmetic product. A better hooking on the skin limits slipping of the application endpiece and facilitates the adoption of a suitable gesture. The pattern may be formed directly during manufacture of the applicator (by additive synthesis, for example), it may be engraved, it may be obtained by application of a coating at the surface of the applicator (for example by flocking), or in any other suitable manner.

Each branch may include a surface coating, for example a metallic coating or an elastomeric coating. A metallic coating, for example by vapour phase deposition, confers on the branches a metallic appearance and touch. An elastomeric coating enables a better adhesion on the skin and offers a soft feel on contact on the skin. Any other coating offering a particular effect in terms of interaction between the skin and the applicator may be considered. In particular, a varnish, a varnish loaded with particles, a flocking, etc.

The applicator may further include a longitudinal rigid stick linking the gripping element to the application endpiece.

In particular, the applicator may include a cylindrical rigid core extending according to the main axis, said core being rigidly fastened to the gripping element or formed in one-piece with the gripping element, the stick being hollow and mounted free in rotation but fixed in translation on the core, the application endpiece being rigidly linked to the stick or formed in one-piece with the stick, and the core extending in the hollow stick over the entire length of the stick measured in the direction of the main axis, possibly with the exception of a connection area between the stick and the application endpiece.

This configuration confers a good transverse rigidity on the applicator, which enables an effective massage during the application. The risk of clogging of the mechanism enabling the rotation of the application endpiece by cosmetic product is also reduced.

In particular, the stick may be metallic or made of ceramic, or covered with a metallic or ceramic coating. In particular, a stick formed of the same material as the application endpiece or having the same aspect allows forming a very aesthetically-pleasing applicator.

The invention also relates to a set including a bottle and an applicator as defined hereinabove, wherein the bottle contains the cosmetic product, the bottle including a neck adapted to be sealed off by the gripping element, so that, when the bottle is sealed off by said gripping element, the application endpiece is in contact with the cosmetic product.

In the appended drawings, given by way of non-limiting examples:

Figure 1:
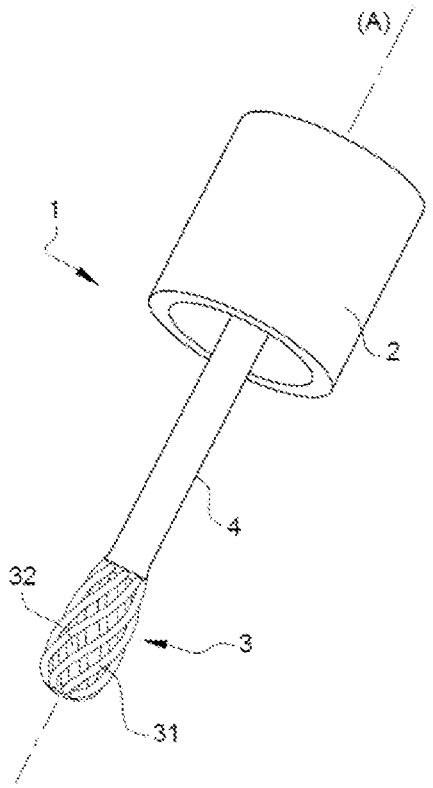
FIG. 1 is a three-dimensional schematic view of a cosmetic product applicator according to an embodiment of the invention.

FIG. 1 shows a cosmetic product applicator 1 in accordance with an embodiment of the invention. This applicator 1 includes a gripping element 2 that the user grasps with his/her hand when he/she wishes to apply the cosmetic product.

The applicator extends according to a general direction of extension, around a main axis A. The general direction of extension of the applicator is so-called longitudinal.

The applicator 1 includes an application endpiece 3. The application endpiece 3 corresponds to the portion of the applicator intended to be loaded with the cosmetic product and to be brought into contact with the skin in order to transfer the cosmetic product therein.

In the exemplary embodiment shown herein, the application endpiece 3 is mounted at the end of a stick 4 which extends over the main axis A and links the gripping element 2 to the application endpiece 3.

According to the present invention, the application endpiece 3 is mounted free in rotation, about the axis A, relative to the gripping element 2. In the illustrated configuration, at least two solutions could thus be implemented: either the endpiece of rotatably mounted relative to the stick 4, which could then be fixed with respect to the gripping element 2, or the application endpiece 3 and the stick 4 are fixed relative to each other (for example made in one-piece) and the stick 4 is rotatably mounted relative to the gripping element. An embodiment according to this second possibility is described as example in more details with reference to FIG. 5.

Figure 2:
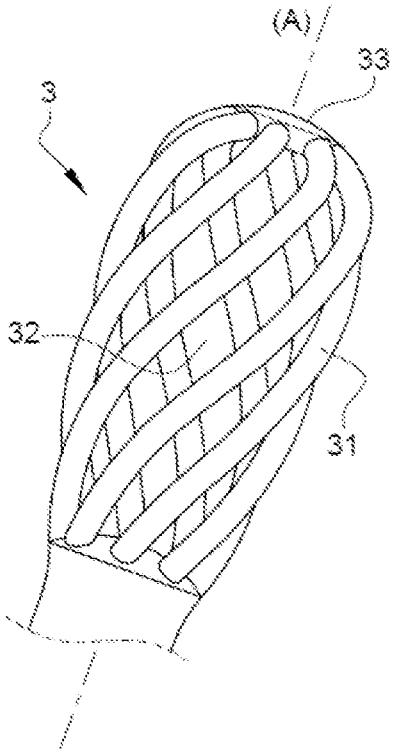
FIG. 2 is a three-dimensional schematic view of an application endpiece that can be used in an embodiment of the invention.

FIG. 2 shows the application endpiece 3 of the applicator 1 of FIG. 1 in more details.

The application endpiece 3 is formed around the main axis A, and has an axisymmetric general shape. More particularly, the application endpiece includes branches 31 which spiral around the main axis A, and thus define a cavity 32 internal to the application endpiece. The cavity 32 has an axisymmetric shape around the main axis A.

Thus, the application endpiece 3 may generally be considered as a hollow endpiece.

Each branch 31 turns, while spiralling around the main axis A; by an angle comprised between 90° and 720°, preferably in the range of 180°. Thus, each branch forms, between its ends, between one quarter-turn and two turns around the main axis of the applicator.

Thus, for example, each branch may form a helix portion around the main axis A.

Advantageously, the application endpiece 3 includes at least three branches 31. Thus, the application endpiece may include exactly three, four, five, six, seven, eight, nine, or ten branches.

The branches 31 may be formed of various materials. They may be metallic, for example made of stainless steel. They may be made of ceramic. They may be made of a plastic material. They may be made of wood, or another suitable natural material.

Advantageously, the surface of the branches is devoid of protuberances. By protuberance, it should be understood an element significantly projecting from the surface of the branches. Thus, the branches advantageously have no teeth or hairs. Yet, this does not exclude the presence of an undulation or of local deformations allowing improving the massage effect during the application of the cosmetic product. Furthermore, this does not exclude the presence of a slightly protruding (or recessed) texture at the surface of the branches, to improve the retention of the cosmetic product by the application endpiece 3 and/or improve adhesion on the skin during the application of the cosmetic product. This texture may be generated directly in the matter forming the branches (by machining, or obtained directly during the manufacture of the applicator) or by application of a coating over the branches.

Moreover, the branches 31 may be covered with a coating, for example a metallic coating which improves the appearance of the application endpiece and, where appropriate, the freshness feel upon application. Coating by vapour phase deposition may be carried out.

Alternatively, the branches may be covered with an elastomeric material coating. This includes any polymer having elastic properties, in particular organic polymers, such as rubbers, and mineral polymers such as silicones. This coating may be overmoulded over the branches 31. An elastomeric coating has a soft and flexible touch and improves adhesion on the skin.

A coating by flocking is also possible, in particular to obtain a "velvet" effect.

Preferably, the branches have a rounded section. Thus, the cross-section of the branches 31 may be circular, oval, or else square or triangular with rounded angles.

In the embodiment that is shown, the application endpiece 3 (and the corresponding cavity 32) has a so-called "bud"-like axisymmetric shape. A bud-like shape refers to an elongate axisymmetric shape flaring progressively and terminating in a rounded tip 33.

Nevertheless, in the context of the present invention, any axisymmetric shape may be considered for the application endpiece.

In particular, a pear-like shape, a rugby ball like oval shape, or a cylindrical shape may be considered. Moreover, the main body may progressively narrow, so as to feature, for example, an ogive-like shape.

Advantageously, the branches 31 are evenly distributed radially around the main axis A. This could be described as a radially symmetrical distribution. In other words, over the entire cross-section of the application endpiece, each branch is at the same distance from the two branches that surround it (or are diametrically opposite if there are only two branches).

In an applicator in accordance with the present invention, the cavity 32 forms a volume adapted to receive a cosmetic product and retain it. Thus, the cavity 32 forms a cosmetic product reserve, which will be released, through the spaces present between the branches 31, during the application of the cosmetic product.

Thus, the volume of the cavity can be adapted to the cosmetic product volume desired for application over a defined area of the body. For example, it could be interesting to ensure that the application endpiece is loaded with a suitable (sufficient by not excessive) amount of cosmetic product for application over the surface to be treated. For example, the applicator may be adapted to enable application over the surface of the bottom of an eye, or possibly over the surface of the bottom of both eyes (in the case where the product could, without limitation, be a cream or a serum against dark circles). The applicator may be adapted to application over the surface of a cheek or of both cheeks. The applicator may be adapted to enable the application of a product over the entirety of the surface of the face, and/or of the neck.

Of course, the examples hereinabove are not restrictive, and the applicator may be adapted to any particular surface of the skin.

The shape and the dimensions of the application endpiece 3 may be adapted accordingly.

Figure 3:
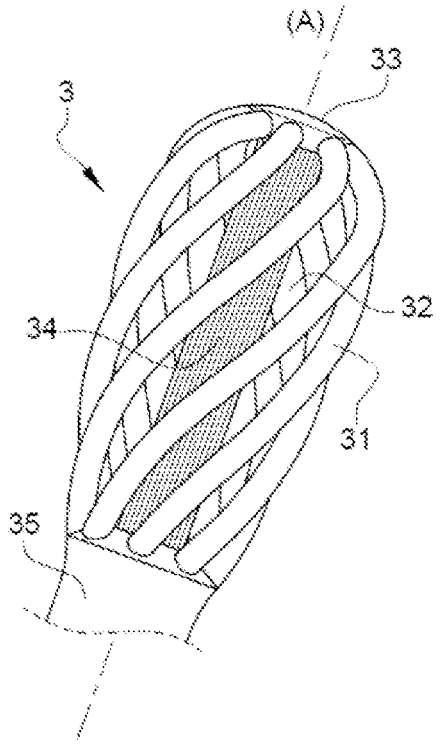
FIG. 3 is a three-dimensional schematic view of another application endpiece that can be used in an embodiment of the invention.

While the cavity of the application endpiece of FIG. 2 is devoid of any inner element, the cavity 32 of the application endpiece of FIG. 3 includes a central element, namely an elongate central element 34, extending over the main axis A.

The elongate central element 34 is herein cylindrical, but any other suitable shape may be used.

The elongate central element 34 links a proximal endpiece 35 of the application endpiece 3 which enables connection thereof to the stick 4 at the tip 33 of the application endpiece.

The elongate central element 34 may be formed of the same material as the branches 31. In particular, it may be made in one-piece with the branches 31.

The elongate central element 34 may have several functions. It may allow adapting the volume of the cavity 32, independently of the external shape of the application endpiece 3.

It could allow rigidifying the application endpiece, while keeping the distance between the proximal endpiece 35 and the tip 33, and possibly their relative position, constant.

Figure 4:
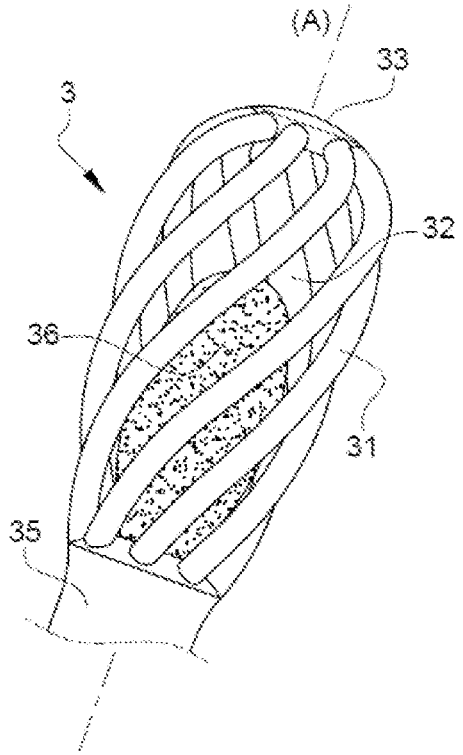
FIG. 4 is a three-dimensional schematic view of another application endpiece that can be used in an embodiment of the invention.

FIG. 4 shows another example of an endpiece wherein the cavity 32 of the application endpiece of FIG. 3 includes a central element in the form of a bulb 36. The bulb 36 is linked to the proximal endpiece 35 of the application endpiece 3, yet without lining it to the tip 33. Thus, the bulb 36 allows modulating the volume available for receiving the product in the applicator, yet without affecting the ability to deform during application, and more generally the mechanical properties that the applicator would have in the absence of thus bulb 36.

Figure 5:
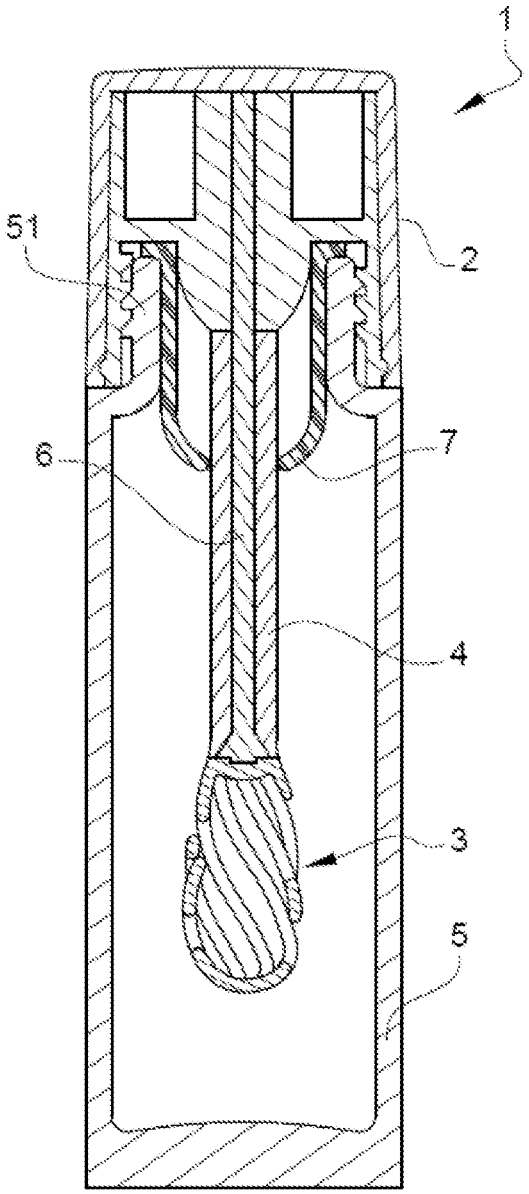
FIG. 5 is a sectional view of a set including the applicator according to an embodiment of the invention and a cosmetic product bottle.

FIG. 5 shows, according to a sectional schematic view, a set including a bottle 5 and the applicator 1 of FIG. 1. The gripping element 2 also forms herein a cap adapted to be screwed onto the cosmetic product bottle 5 that an adapted neck 51 includes. To this end, the cap may be provided with a tapping. According to other embodiments, the cap could be adapted to be affixed on the bottle by clipping.

In the exemplary embodiment of FIG. 5, the application endpiece 3 is rigidly fastened to the stick 4. The stick 4 is hollow, and mounted free in rotation over a rigid and longitudinal core 6, which is rigidly fastened to the gripping element 2.

However, the stick 4 is fixed in translation along the core 6.

The bottle 5 forms an inner volume containing a liquid, viscous or pasty, for example semi-liquid, cosmetic product.

When the applicator 1 is affixed on the bottle 5 (the gripping element 2 forming a suitable cap), the application endpiece 3 is in contact with the cosmetic product. For example, the application endpiece 3 is immersed in the cosmetic product. Thus, the application endpiece 3 is loaded with the cosmetic product, at its surface and in the cavity 32.

The bottle 5 includes a wiper 7. The wiper 7 is a flexible device located proximate to the neck 51 of the bottle 5 or in the latter. The wiper 7 provides for a passage calibrated for the insertion and removal of the application endpiece 3. The wiper 7 allows pulling off the excess cosmetic product at the surface of the application endpiece 3 upon removal from the bottle 5. Thus, a perfect compliance with the cosmetic product dose defined essentially by the volume of the cavity 32. Thus, an accurate, even and optimum predetermined cosmetic product amount for application over a given area of the body of the user, is contained in and over the application endpiece 3.

The wiper 7 may be of the so-called "folding" type. Such a wiper 7 has a frustoconical shape and tends to fold upon passage of the application endpiece 3.

The cosmetic product applicator, including the care product proposed in the invention, including a rotatably-mounted hollow application endpiece with spiraling branches, enables an even application, in an even film, of an accurate amount of product throughout the rotation of the application endpiece over the skin of the user. The branches of the application endpiece accompany the application movement, which causes the rotation of the endpiece by rolling over the application surface (typically the skin), and allows for an even adhesion, without jerkin, over the skin of the user. They also promote the massage effect during application of the product.

The invention claimed is:

1. A cosmetic product applicator comprising:
an application endpiece;
a gripper configured to be gripped by a user;
the application endpiece including branches that extend while spiralling around a main axis so that they define a cavity having an axisymmetric general shape around the main axis; and
the application endpiece being mounted free in rotation about the main axis in relation to the gripper.

2. The applicator according to claim 1, wherein:
the cavity is devoid of any inner element.

3. The applicator according to claim 1, wherein:
the cavity includes a central element extending over the main axis.

4. The applicator according to claim 1, wherein:
the cavity has a so-called bud-like shape in a form of an elongate axisymmetric shape flaring progressively and terminating in a rounded tip.

5. The applicator according to claim 1, wherein:
the branches are devoid of protuberances.

6. The applicator according to claim 1, wherein:
said branches include exactly three, four, five, six, seven, eight, nine or ten branches.

7. The applicator according to claim 1, wherein:
each of said branches is configured to rotate while spiralling around the main axis by an angle comprised between 90° and 720°.

8. The applicator according to claim 1, wherein:
each of said branches is configured to rotate while spiralling around the main axis by an angle in a range of 180°.

9. The applicator according to claim 1, wherein:
at least the branches of the application endpiece are metallic, made of ceramic, of word, of glass, or of a plastic material.

10. The applicator according to claim 1, wherein:
each of said branches includes at a surface a texture that increases its roughness.

11. The applicator according to claim 1, wherein:
each of said branches includes a surface coating.

12. The applicator according to claim 11, wherein:
the surface coating is a metallic coating or an elastomeric coating, or a flocking.

13. The cosmetic product applicator according to claim 1, further comprising:
a longitudinal rigid stick linking the gripper to the application endpiece.

14. The product applicator according to claim 13, wherein:
the applicator includes a cylindrical rigid core extending according to the main axis, said core being rigidly fastened to the gripper or formed in one-piece with the gripper;
the stick is hollow and mounted free in rotation but fixed in translation on the core;
the application endpiece is rigidly linked to the stick or formed in one-piece with the stick; and
the core extends in the stick over an entirety of a length of the stick measured in a direction of the main axis, possibly with an exception of a connecting area between the stick and the application endpiece.

15. The cosmetic product applicator according to claim 14, wherein;
the stick is metallic or made of ceramic, or covered with a metallic or ceramic coating.

16. A set including a bottle and an applicator according to claim 1, wherein:
the bottle contains the cosmetic product, the bottle including a neck configured to be sealed off by the gripper, so that, when the bottle is sealed off by said gripper, the application endpiece is in contact with the cosmetic product.

* * * * *